US007490895B2

(12) United States Patent
Yeh

(10) Patent No.: US 7,490,895 B2
(45) Date of Patent: Feb. 17, 2009

(54) HIGH CHAIR WITH COLLAPSIBLE FRAME

(75) Inventor: Chuan-Ming Yeh, Chuayi (TW)

(73) Assignee: Link Treasure Limited, Tortola (VG)

( * ) Notice: Subject to any disclaimer, the term of this patent is extended or adjusted under 35 U.S.C. 154(b) by 1 day.

(21) Appl. No.: 11/298,689

(22) Filed: Dec. 12, 2005

(65) Prior Publication Data

US 2006/0125293 A1 Jun. 15, 2006

(30) Foreign Application Priority Data

Dec. 13, 2004 (TW) ..... 93220042 U

(51) Int. Cl.
*A47C 4/00* (2006.01)

(52) U.S. Cl. ..... 297/16.1; 297/46; 297/50

(58) Field of Classification Search ..... 297/16.1, 297/46, 50
See application file for complete search history.

(56) References Cited

U.S. PATENT DOCUMENTS 2,851,086 A * 9/1958 Weiner ..... 297/39
3,425,743 A * 2/1969 Peterson ..... 297/19
4,008,918 A * 2/1977 Cooper et al. ..... 297/16.1
4,603,902 A * 8/1986 Maloney ..... 297/35
4,768,825 A * 9/1988 Quinlan, Jr. ..... 297/39
4,938,603 A * 7/1990 Turner et al. ..... 297/16.1
5,104,180 A * 4/1992 Takahashi et al. ..... 297/16.1
5,707,104 A * 1/1998 Perego ..... 297/16.1
6,126,236 A * 10/2000 Wu ..... 297/325
6,129,414 A * 10/2000 Brevi ..... 297/16.1
6,347,830 B1 * 2/2002 Chen ..... 297/16.1
7,128,367 B2 * 10/2006 You et al. ..... 297/48

* cited by examiner

*Primary Examiner*—Sarah B McPartlin
(74) *Attorney, Agent, or Firm*—Muncy, Geissler, Olds & Lowe, PLLC

(57) ABSTRACT

A collapsible high chair frame including a supporting stand, a seat, a connecting device and a positioning device. The supporting stand is provided with a rear and a front supporting leg which are foldable toward each other. The seat has a base and a back which are connected pivotally to each other. The connecting device is pivotally coupling to the supporting stand and the seat. According to the configuration of this invention, the connecting device is rotatable by releasing a lock on the positioning device which is arranged between the connecting device and the seat, meanwhile, the rear supporting leg is closed up to the front supporting leg and also folded toward the base and back of the seat at the same time. The collapsible high chair can be stored with a compact frame.

6 Claims, 5 Drawing Sheets

HIGH CHAIR WITH COLLAPSIBLE FRAME

FIELD OF THE INVENTION

This invention relates to collapsible high chairs for children and, in particular, to a connecting device which is simultaneously folded a seat and minimized the size in a collapsed status.

BACKGROUND OF THE INVENTION

High chairs are widely accepted as necessary appliances for seating young children comfortably during a meal. The related inventions of high chairs are: for example, U.S. Pat. No. 5,435,620 to Chen at al., U.S. Pat. No. 4,958,885to Kassai at al., U.S. Pat. No. 5,509,719 to Cone II at al., U.S. Pat. No. 5,348,374 to Kuo., U.S. Pat. No. 5,507,550 to Maloney; U.S. Pat. No. 5,806,922 to Mendelovich at al., U.S. Pat. No. 5,829,826 to Ziccardi at al., U.S. Pat. No. 5,927,805 to Hilger at al., U.S. Pat. No. 5,951,102 to Poulson at al., and U.S. Pat. No. 6,010,184 to Lee at al. The above mentioned high chairs have generally included a seat, seat legs and a food tray is arranged at the supporting legs which supports the seat upon the ground.

Various seat legs of high chairs are shown in above patents, for instance, a kind of fixed seat legs is disclosed by U.S. Pat. Nos. 5,806,922 and 5,927,805. Another kind of seat with two expandable legs which two upper ends are connected, the lower end are separated; An angle is formed between the two legs in order to support the seat above the ground such as U.S. Pat. Nos. 5,507,550 and 5,951,102. In addition, U.S. Pat. Nos. 5,509,719; 5,435,620 and 4,958,885 are disclosing a seat with reclined legs including a first leg lay horizontally on the ground and a second leg which connects to one end of the first leg and formed an angle between the first leg.

The reclined seat legs are sorted into three categories which are stationary legs as shown in U.S. Pat. No. 5,509,719; assembled legs as shown in U.S. Pat. No. 5,435,620 and foldable legs as shown in U.S. Pat. No. 4,958,885. Said stationary legs are fixed and a bigger space is needed for storage. The assembled one is inconvenience for user to assemble and disassemble even though the storage size is much small. Compared to above invention, the foldable legs are easy for user to storage by pushing the first leg to second leg, but the folding mechanism seems complicated as you can see from said U.S. Pat. No. 4,958,885.

SUMMARY OF THE INVENTION accordingly, there is a object of the present invent to provide a collapsible high chairs suitable for children with simple folding mechanism.

A high chair with collapsible frame for children according to the preferred embodiment of this invention is including a foldable supporting stand, a seat, a connecting shaft and a positioning means. The collapsible supporting stand is provided with a rear supporting leg, a front supporting leg and a joint means. The joint means is arranged at the upper part of the rear supporting leg as well as the front supporting leg. When folding the collapsible frame, the rear supporting leg and the front supporting leg are closed to each other. In addition, the seat has a base which is pivotally associated with a back; the base is connected by the connecting device and the foldable supporting stand. Under the control of the positioning means which is located between the connecting device and the seat, the seat is folded simultaneously through the connecting device when the foldable supporting stand is collapsed. With this arrangement, the high chair is of a foldable reduced-bulk frame.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Figure 1:
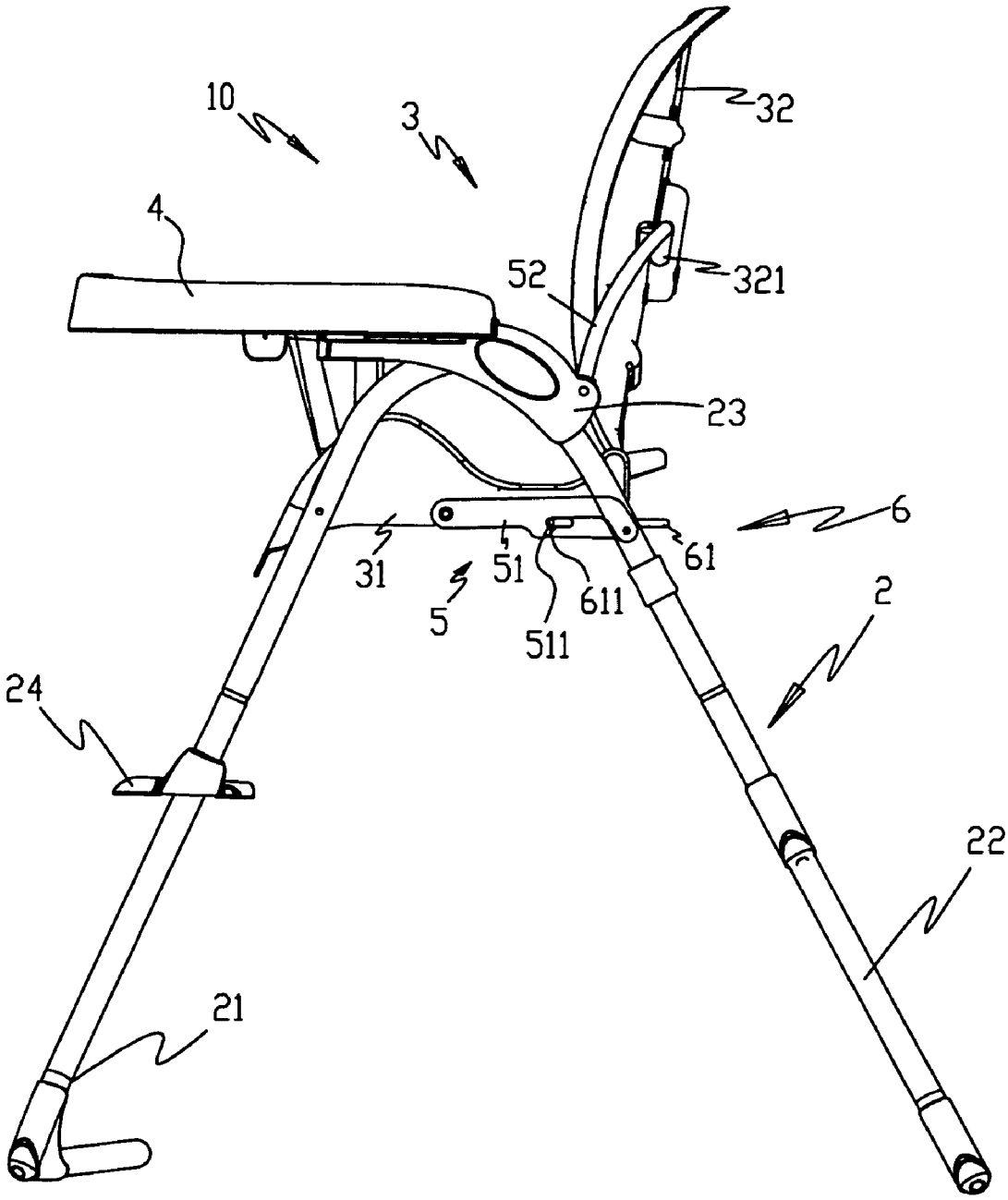
FIG. 1 is a side plane view of the high chair constructed in accordance with the present invention.

Referring to FIG. 1, the high chair with reduced-bulk and easy storage collapsible frame 10 consists of a foldable supporting stand 2, a seat 3 and a connecting device 5 according to the preferred embodiment of present invention.

The foldable supporting stand 2 consists of a front supporting leg 21, a rear supporting leg 22 and a joint means 23, wherein said front and rear supporting legs 21, 22 set in a "U" like configuration. The joint means 23 connects to upper part of the front and rear supporting legs 21, 22. In the status of operation, a supporting stand 2 is formed by pivotally rotating the front supporting leg 21 and rear supporting leg 22 along a pivot point away from each other, and suspends the seat 3 on the supporting stand 2. When folding the foldable supporting stand 2, the front supporting leg 21 and the rear supporting leg 22 approached to each other same as being rotated pivotally along the pivot point. The front end of joint means 23 connects to a food tray 4 which can be adjusted either forward or backward. A foot rest 24 is located in the middle of the leg for putting child's feet.

Figure 2:
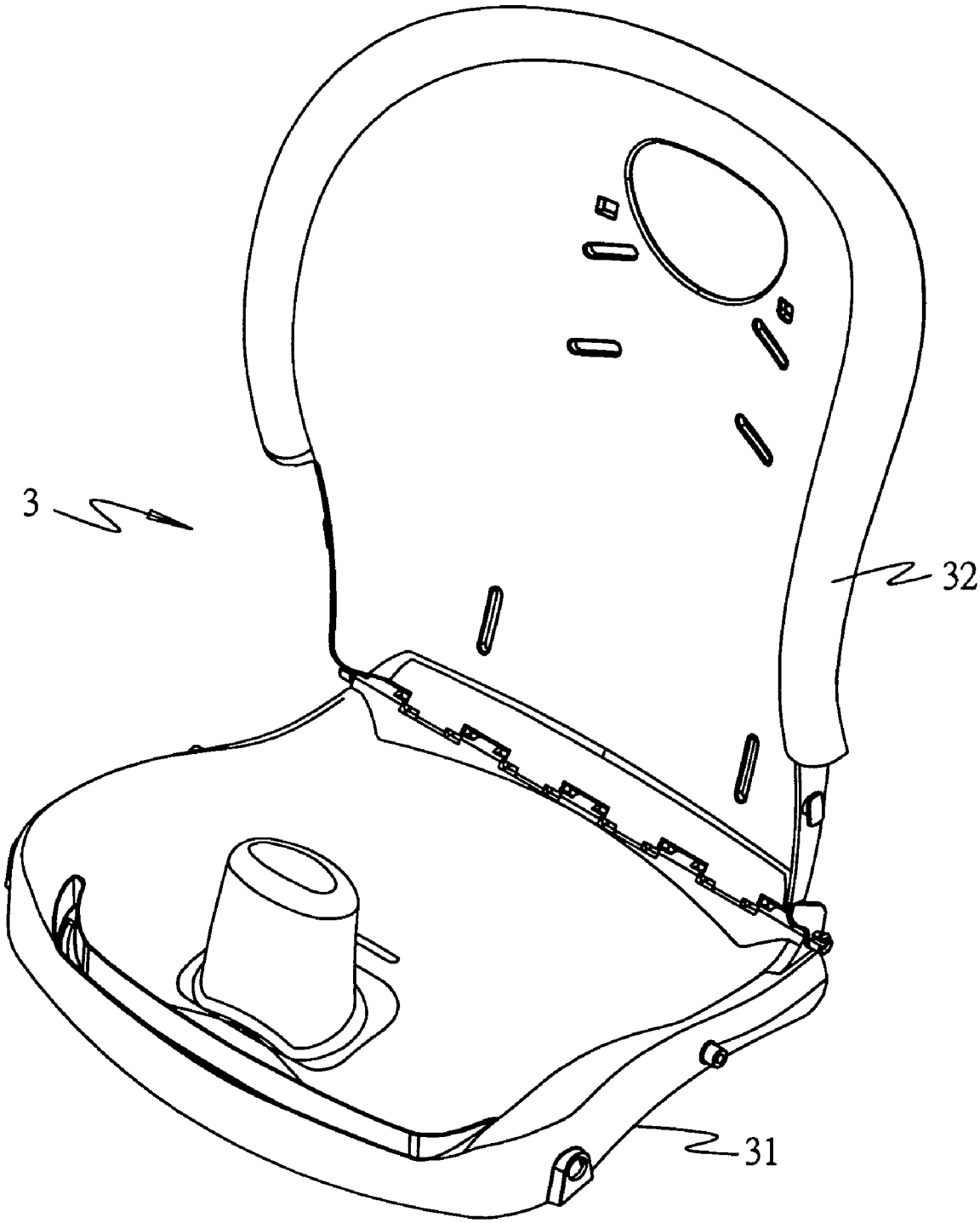
FIG. 2 is a fragmentary top perspective view of the high chair constructed in accordance with the present invention

Referring to FIG. 2, the seat 3 consists of a base 31 and a back 32. The seat 31 and back 32 are pivotally connected to each other. The base 31 of the seat 3 is pivotally connected to front supporting leg 21, an angle about or above 90 degrees is formed between the base 31 and the back 32 for accommodating a child in a comfortable position. When folding the collapsible frame 10, the base 31 and the back are folded with an angle smaller than 90 degrees among them.

The connecting device 5 pivotally connects between the base 3 and the foldable supporting stand 2, which consists of first connecting bar 51 and second connecting bar 52, wherein the first connecting bar 51 is pivotally connected among the base 31 of the seat 3 and the rear supporting leg 22. The first connecting bar 51 is also provided with a positioning portion 511. According to preferred embodiment of this invention, the positioning portion 511 is an indention, and the second connecting bar 52 is formed in ∩-shaped. Both two ends of second connecting bar 52 are pivotally connected to the joint means 23 which are located on both side of the collapsible frame 10. The middle portion of second connecting bar 52 supports the back 32 by passing through a slot 321 which is extended from the back 32. Therefore, when folding the foldable supporting stand 2, the rear supporting leg 22 is moved forward to the front supporting leg 21; meanwhile, the first and second connecting bar 51, 52 are linked and actuated the base 31 and the back 32 of the seat 3, the seat 3 then folded with an angle less than 90 degrees between the base 31 and the back 32.

Figure 3:
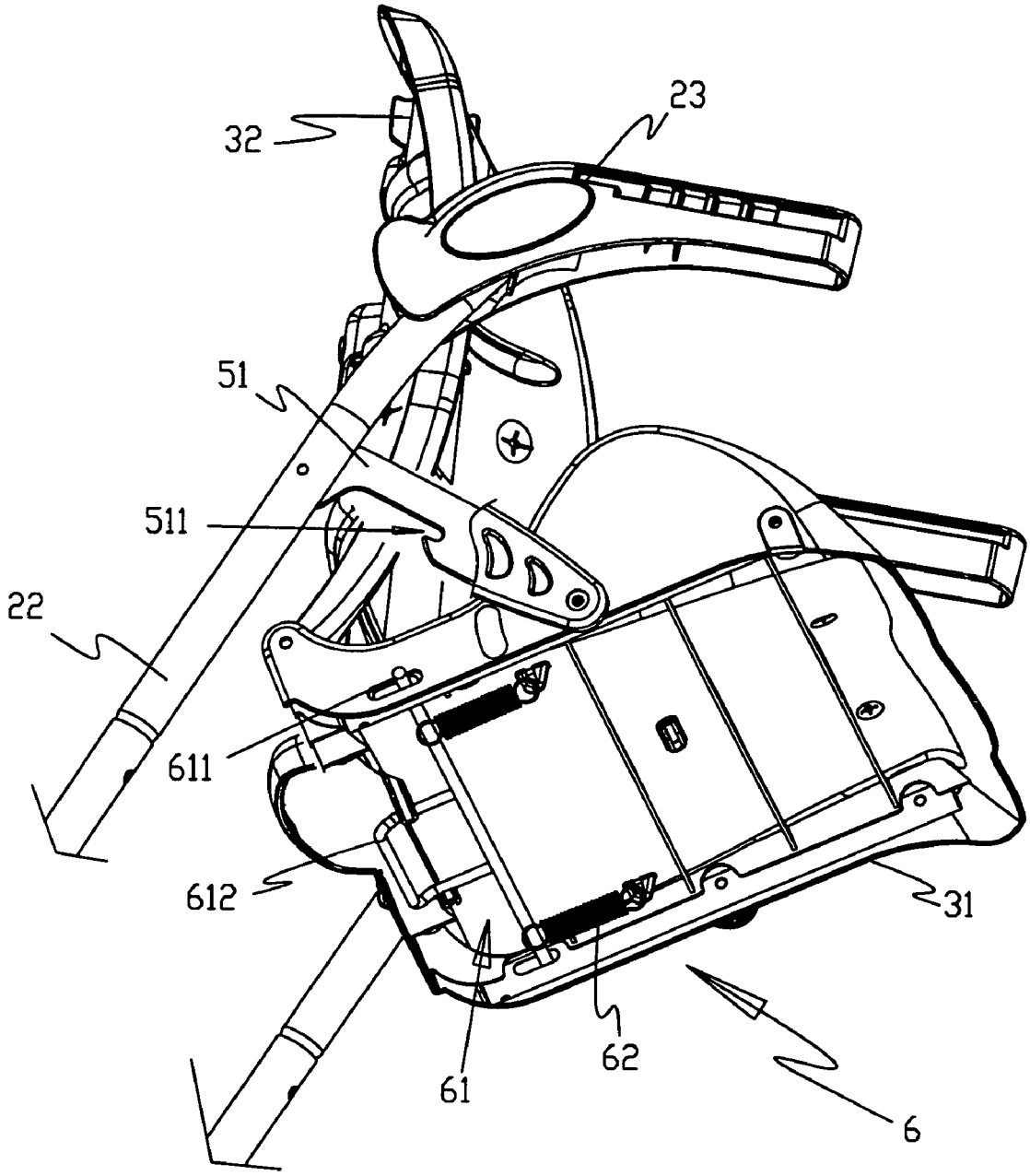
FIG. 3 is a an enlarged, fragmentary side plane view of the high chair constructed in accordance with the present invention
Figure 4:
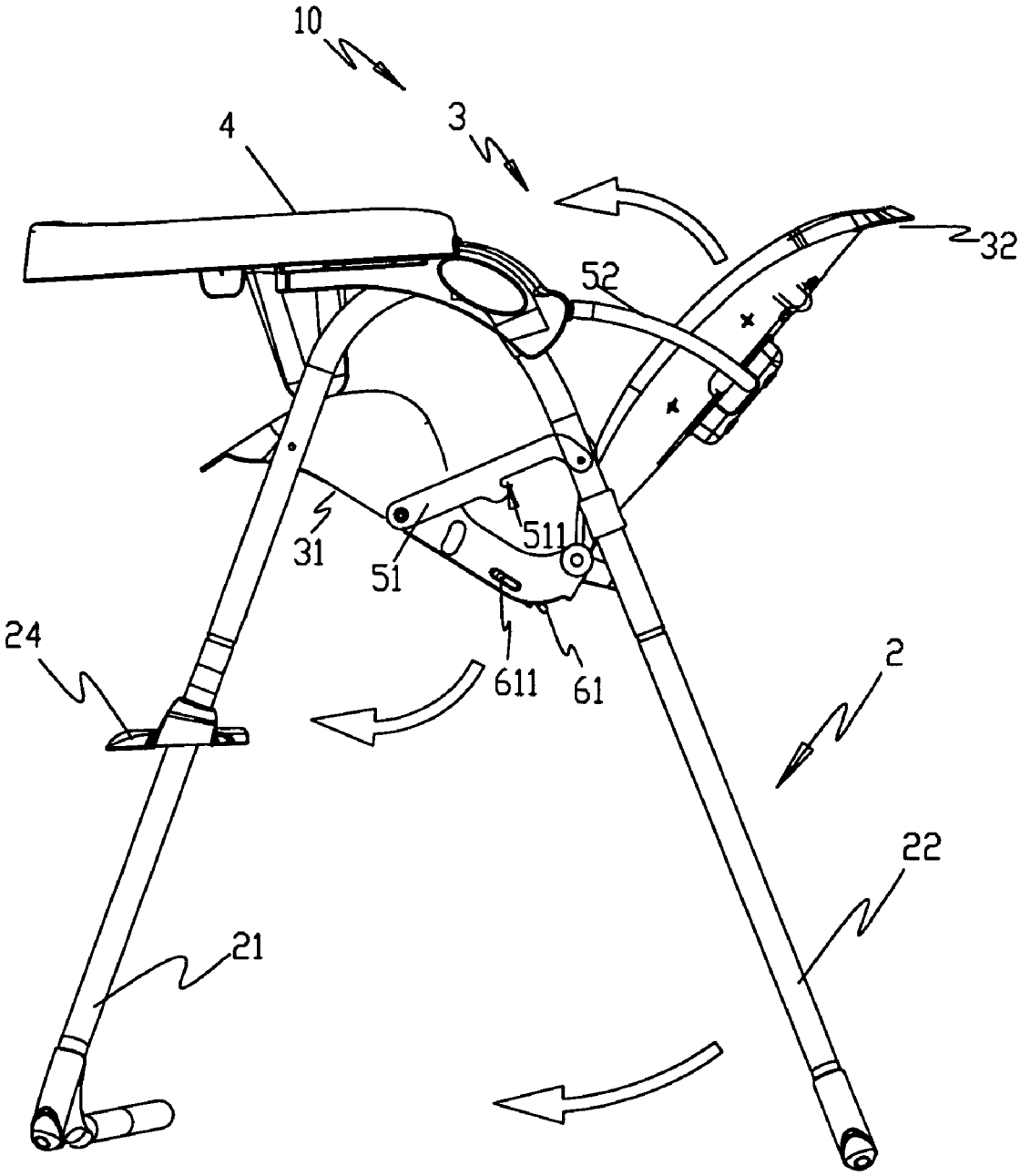
FIG. 4 is a an side plane view showing the folding operation of the high chair constructed in accordance with the present invention
Figure 5:
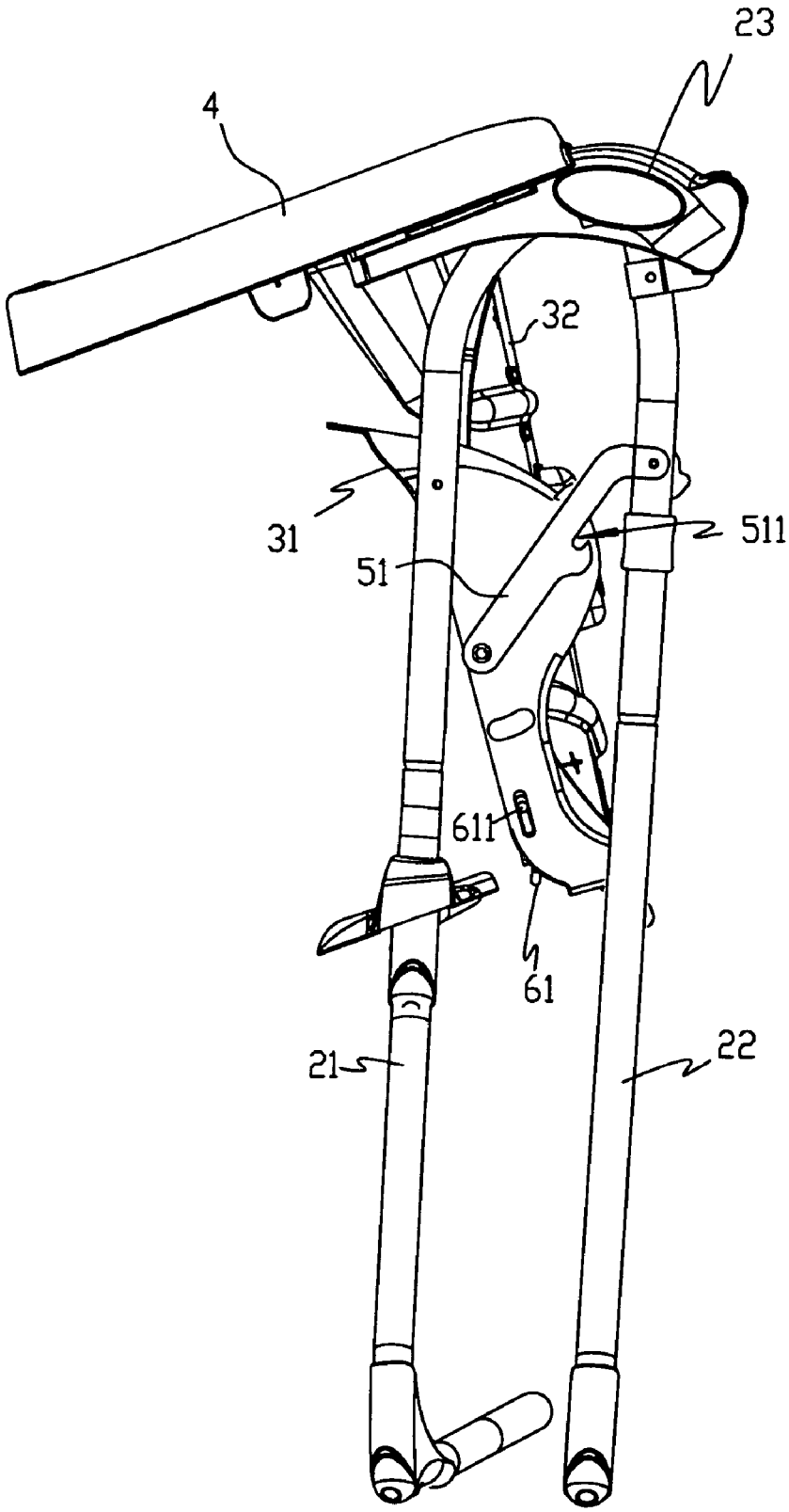
FIG. 5 is a an side plane view showing the folded status of the high chair constructed in accordance with the present invention

With reference to FIGS. 3 to 5, a positioning means 6 is arranged at lower portion of the base 31 of the seat 3 and consists of a releasable bar 61 and a elastic element 62, wherein the releasable bar 61 which defines gliding elements including a locking shaft 611 and a holding tab 612 and arranged at the bottom of the base 31. The locking shaft 611 is transverse projected from both sides of the base 31. When unfolding the collapsible frame 10, the two ends of the locking shaft 611 inserted into the positioning portion 511 of the first connecting bar 51, whereby the elastic element 62 between the base 3 and the releasable bar 61 retains the locking shaft 611 which inside the positioning portion 511 of the first connecting bar 51, therefore, the high chair is expended steady. When collapsing the frame 10, the user should pull the releasable bar 61 and disengage the locking shaft 611 of releasable bar 61 from the positioning portion 511 and became a folding status of the high chair, as better shown in FIG. 5. Furthermore, the rear supporting leg 22 is drawn close to the front supporting leg 21 and folded the base 31 and the back 32 of the seat 3 by means of the connecting device 5, the size or bulk which is reduced for easy transportation or storage as shown in FIG. 5.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A high chair with collapsible frame comprising:

a foldable supporting stand consisting of a front supporting leg, a rear supporting leg and a joint means; wherein the joint means connects the front supporting leg and the rear supporting leg at an upper portion therebetween, and the front supporting leg is closed up to the rear supporting leg when folding the foldable supporting stand;

a seat provided for seating a child and pivotally connected to the foldable supporting stand; wherein the seat further includes a base and a back which are connected to each other;

a connecting device connects to and between the seat and the supporting stand;

said device actuates the base and the back to close simultaneously with the folding of the supporting stand; and a positioning means arranged at a lower portion of the base of the seat and extending to the connecting device; said means enables the collapsible frame to change from a collapsed state to an unfolded state and vice versa;

wherein the connecting device further includes a first connecting bar and a second connecting bar; wherein said first connecting bar has two ends, with one end being pivotally connected to the seat and the other end being pivotally connected to the rear supporting leg; said second connecting bar is formed in an inverted U-shape and has two ends pivotally connected to both sides of the collapsible frame; further, the second connecting bar has a middle portion pivotally connected to the back of the seat for supporting the seat.

2. The high chair of claim 1, wherein the front supporting leg and the rear supporting leg are in a U shape configuration.

3. The high chair of claim 1, wherein two ends of the second connecting bar are pivotally connected to the joint means which is located on both sides of the frame.

4. The high chair of claim 1, wherein the first connecting bar is provided with a positioning portion.

5. The high chair of claim 1, wherein the positioning means includes a releasable bar and an elastic element; said elastic element is located at and between the seat and the releasable bar for biasing the releasable bar.

6. The high chair of claim 5, wherein the releasable bar further comprising a holding tab and a locking shaft, said locking shaft transversally projects from both right and left sides of the base to the connecting device, and locked with a positioning portion of said connecting device.

* * * * *